US005678986A

United States Patent [19]

Terauchi et al.

[11] Patent Number: 5,678,986

[45] Date of Patent: Oct. 21, 1997

[54] FLUID DISPLACEMENT APPARATUS WITH LUBRICATING MECHANISM

[75] Inventors: Kiyoshi Terauchi, Isesaki; Isao Hoashi; Akiyoshi Higashiyama, both of Sawa-gun, all of Japan

[73] Assignee: Sanden Corporation, Gunma, Japan

[21] Appl. No.: 548,831

[22] Filed: Oct. 26, 1995

[30] Foreign Application Priority Data

Oct. 27, 1994 [JP] Japan ..... 6-263401
Dec. 22, 1994 [JP] Japan ..... 6-320939

[51] Int. Cl.[6] ..... F01C 1/04

[52] U.S. Cl. ..... 418/55.6; 418/87; 418/94; 184/6.16; 184/34

[58] Field of Search ..... 418/55.6, 87, 94, 418/96; 184/6.16, 7.4, 34

[56] References Cited

U.S. PATENT DOCUMENTS

| | | | |
|---|---|---|---|
| 3,838,942 | 10/1974 | Pokorny . | |
| 4,314,796 | 2/1982 | Terauchi . | |
| 4,332,535 | 6/1982 | Terauch et al. . | |
| 4,340,339 | 7/1982 | Hiraga et al. | 418/55.6 |
| 4,484,869 | 11/1984 | Nakayama et al. . | |
| 4,527,963 | 7/1985 | Terauchi . | |
| 4,538,975 | 9/1985 | Tsukagoshi . | |
| 4,547,138 | 10/1985 | Mabe et al. . | |
| 4,561,832 | 12/1985 | Shimizu . | |
| 4,900,238 | 2/1990 | Shigemi et al. . | |
| 4,936,756 | 6/1990 | Shimizu et al. . | |
| 4,958,991 | 9/1990 | Kikuchi . | |
| 4,968,232 | 11/1990 | Kikuchi . | |
| 5,505,595 | 4/1996 | Fukui | 418/55.6 |

FOREIGN PATENT DOCUMENTS

| | | | |
|---|---|---|---|
| 55-60685 | 5/1980 | Japan . | |
| 61-212689 | 9/1986 | Japan . | |
| 176689 | 7/1988 | Japan | 418/55.6 |
| 5133356 | 5/1993 | Japan | 418/55.6 |

*Primary Examiner*—Charles G. Freay
*Attorney, Agent, or Firm*—Baker & Botts, L.L.P.

[57] ABSTRACT

A fluid displacement apparatus includes a housing having a fluid inlet and a fluid outlet. A suction chamber is formed between one end of the displacement mechanism and the housing and communicates with the fluid inlet port. A discharge chamber is formed between other end of the displacement mechanism and the housing and communicates with the fluid outlet port. A first hollow space is created between a peripheral surface of a driving mechanism and the inner block, and communicates with the suction chamber. A second hollow space is created between the inner block and the housing and communicates with the discharge chamber. A pressure differential regulating device is disposed between the first hollow space and the second hollow space. Accordingly, a sealing mechanism of a driving mechanism achieves superior durability while maintaining the lubrication of a bearing under various operating conditions of the apparatus.

9 Claims, 6 Drawing Sheets

FLUID DISPLACEMENT APPARATUS WITH LUBRICATING MECHANISM

BACKGROUND OF THE INVENTION

1. Field of the Invention

This invention relates to a fluid displacement apparatus, and more particularly, to a lubricating mechanism for lubricating a seal and a bearing of a driving mechanism.

2. Description of the Prior Art

FIG. 1 illustrates a scroll-type fluid displacement apparatus, such as a scroll-type refrigerant compressor, in accordance with a prior art embodiment. With reference to FIG. 1 and the other figures, and for purposes of explanation only, the left side of the figures will be referred to as the forward end or front of the compressor, and the right side of the figures will be reference as the rearward end or rear of the compressor.

In FIG. 1, compressor 300 includes compressor housing 310 having front end plate 311 and cup-shaped casing 312 which is secured to the rear end surface of front end plate 311 by a plurality of bolts 313. An opening 311*a* is formed in the center of front end plate 311 for penetration and passage of steel drive shaft 314. An opening end of cup-shaped casing 312 is covered by front end plate 311, and the mating surfaces between front end plate 311 and cup-shaped casing 312 are sealed by first O-ring 315. First annular sleeve 311*b* projects forwardly from the periphery of opening 311*a* so as to surround an outer end portion of drive shaft 314 and define a shaft seal cavity 311*c* therein. Shaft seal mechanism 414 is disposed within shaft seal cavity 311*c* and is mounted about drive shaft 314. Shaft seal mechanism 414 seals the interior of compressor housing 310 from first annular sleeve 311*b*, thereby preventing refrigerant and lubricating oil therein from leaking through opening 311*a* to the exterior of compressor 300. Shaft seal mechanism 414 suffers from severe wear and tends to breakdown more frequently than most any other parts of compressor 300.

Drive shaft 314 is rotatably supported by first annular sleeve 311*b* through radial needle bearing 316, which is positioned within the front end of first annular sleeve 311*b*. Second annular sleeve 311*d* projects rearwardly from the periphery of opening 311*a* so as to surround an inner end portion of drive shaft 314.

Inner block 320 having front annular projection 321 and rear annular projection 322 is disposed within the interior of housing 310. The interior of housing 310 is defined by the inner wall of cup-shaped casing 312 and the rear end surface of front end plate 311. Inner block 320 is fixedly attached to front end plate 311 at its front annular projection 321 by a plurality of bolts 317, so that front end plate 311 of inner block 320 surround second annular sleeve 311*d* of front end plate 311, and further, so that a from end surface of front annular projection 321 is in contact with the rear end surface of front end plate 311.

Drive shaft 314 has cylindrical rotor 314*a* which is integral with and coaxially projects from an inner end surface of drive shaft 314. The diameter of cylindrical rotor 314*a* is greater than that of drive shaft 314. Cylindrical rotor 314*a* is rotatably supported by inner block 320 through radial plane bearing 325 which is fixedly disposed within opening 323 centrally formed through inner block 320. Radial plane bearing 325 is fixedly disposed within opening 323 by, for example, forcible insertion. Pin member 314*b* is integral with, and projects from, a rear end surface of cylindrical rotor 314*a*. The axis of pin member 314*b* is radially offset from an axis of cylindrical rotor 314*a*, i.e., the axis of drive shaft 314 by a predetermined distance.

An electromagnetic clutch 318, which is disposed around first annular sleeve 311*b*, includes pulley 318*a* rotatably supported on sleeve 311*b* through ball beating 318*b*, electromagnetic coil 318*c* disposed within an annular cavity of pulley 318*a*, and armature plate 318*d* fixed on an outer end of drive shaft 314, which extends from sleeve 311*b*. Drive shaft 314 is connected to and driven by an external power source through electromagnetic clutch 318.

The interior of housing 310 further accommodates fixed scroll 330, orbiting scroll 340, and rotation preventing mechanism, such as Oldham coupling mechanism 350, which prevents rotation of orbiting scroll 340 during operation of the compressor.

Fixed scroll 330 includes circular end plate 331, a first spiral element 332 affixed to or extending from a front side surface of circular end plate 331, and an outer peripheral wall 333 forwardly projecting from an outer periphery of circular plate 331. Outer peripheral wall 333 of fixed scroll 330 is fixedly attached to rear annular projection 322 of inner block 320 by a plurality of screws 319, so that a rear end surface of rear annular projection 322 of inner block 320 is in contact with a front end surface of outer peripheral wall 333 of fixed scroll 330. Thus, fixed scroll 330 is fixedly disposed within the interior of housing 310.

A second O-ring 334 is elastically disposed between an outer rear peripheral surface of circular end plate 331 and an inner peripheral surface of cylindrical portion 312*a* of cup-shaped casing 312 to seal the mating surfaces therebetween. Thus, first discharge chamber 360 is defined by circular end plate 331 of fixed scroll 330 and a rear portion 312*b* of cup-shaped casing 312. Another O-ring 324 is elastically disposed between an outer rear peripheral surface of rear annular projection 322 of inner block 320 and the inner peripheral surface of cylindrical portion 312*a* of cup-shaped casing 312 to seal the mating surface therebetween. Thus, suction chamber 370 is defined by circular end plate 331 of fixed scroll 330, which is a pan of cylindrical portion 312*a* of cup-shaped casing 312 and inner block 320; and second discharge chamber 380 is defined by inner block 320, which is a pan of cylindrical portion 312*a* of cup-shaped easing 312, and front end plate 311.

Inlet port 310*a* is formed on cylindrical portion 312*a* of cup-shaped casing 312 at a position corresponding suction chamber 370. Outlet port 310*b* is formed on cylindrical portion 312*a* of cup-shaped casing 312 at a position corresponding to second discharge chamber 380 in order to place second discharge chamber 380 in communication with the exterior of compressor 300.

A plurality of fluid passages 395 are axially formed through outer peripheral wall 333 of fixed scroll 330 and rear annular projection 322 of inner block 320 along the periphery thereof so as to link first discharge chamber 360 to second discharge chamber 380. They are located in the vicinity of holes 333*a*, through which a shaft portion of screws 319 penetrates.

A discharge port 335 is formed through circular end plate 331 of fixed scroll 330 at a position near the center of spiral element 332. Reed valve member 336 cooperates with discharge port 335 at a rear end surface of circular end plate 331 of fixed scroll 330 to control the opening and closing of discharge port 335 in response to a pressure differential between first discharge chamber 360 and central fluid pocket 390*a*. Retainer 337 is provided to prevent an excessive bending of reed valve member 336 when discharge port 335 is opened. An end of reed valve member 336 is fixedly secured to circular end plate 331 of fixed scroll 330 by single bolt 338, together with one end of retainer 337.

Orbiting scroll 340, which is located in suction chamber 370, includes circular end plate 341 and a second spiral element 342 affixed to or extending from a rear side surface of end plate 341. Second spiral element 342 of orbiting scroll 340 and first spiral element 332 of fixed scroll 330 interfit at an angular offset of 180 and a predetermined radial offset to make a plurality of line contracts. Therefore, at least one pair of sealed off fluid pockets 390 are defined between spiral elements 332 and 342. Baffle 339 is disposed within first discharge chamber 360 so as to cover discharge port 335 and secured to circular end plate 331 of fixed scroll 330 by bolt 351. Baffle 339 causes lubricating oil mist flowing from discharge port 335 to change to condense and to flow to the lower portion of first discharge chamber 360.

Additionally, orbiting scroll 340 further includes an annular boss 343, which projects forwardly from a central region of a front end surface of circular end plate 341. Bushing 344 is rotatably disposed within boss 343 through radial plane bearing 345. Radial plane bearing 345 is fixedly disposed within boss 343 by, for example, forcible insertion. Bushing 344 has hole **344*a* axially formed therethrough. The axis of hole 344*a* is radially offset from an axis of bushing 344. As described above, pin member 314*b* is integral with, and projects from, the rear end surface of cylindrical rotor 314*a* of drive shaft 314. The axis of pin member 314*b* is radially offset from the axis of cylindrical rotor 314*a*, i.e., the axis of drive shaft 314**, by a predetermined distance.

Pin member **314*b* is rotatably disposed within hole 344*a* of bushing 344. A terminal end portion of pin member 314*b* projects from a rear end surface of bushing 344, and a snap ring 346 is fixedly secured to the terminal end portion of pin member 314*b* to prevent axial movement of pin member 314*b* within hole 344*a* of bushing 344. Thus, drive shaft 314, pin member 314*b*, and bushing 344 form a driving mechanism for orbiting scroll 340. Counter balance weight 347 is disposed within suction chamber 370 at a position forward of circular end plate 341 of orbiting scroll 340, and is connected to a front end of bushing 344. Annular flange 314*c* may be made of steel and formed at a position which constitutes a boundary between the inner end portion of drive shaft 314 and cylindrical rotor 314*a*. The diameter of annular flange 314*c* is greater than the diameter of cylindrical rotor 314*a***.

First thrust plane bearing 326 is fixedly disposed within an annular cut-out portion **311*e*, which is formed at an outer peripheral region of the rear end surface of second annular sleeve 311*d*, by a plurality of fixing pins 326*a*. A rear end surface of first thrust plane bearing 326 projects slightly from the rear end surface of second annular sleeve 311*d*. The rear end surface of first thrust plane bearing 326 projects slightly from the rear end surface of second annular sleeve 311*d*. The rear end surface of fixing pins 326*a* is forward of the rear end surface of first thrust plane bearing 326. Nevertheless, first thrust plane bearing 326 may be in frictional contact with annular flange 314*c* and may receive a forward thrust force through annular flange 314*c***.

Second thrust plane bearing 327, which is substantially identical to first thrust plane bearing 326, is fixedly disposed within a shallow annular depression **320*a*, which is formed at the front end surface of inner block 320 along the periphery of opening 323, by a plurality of fixing pins 327*a*. Second thrust plane bearing 327 surrounds a front end portion of radial thrust beating 325 and faces the rear end surface of annular flange 314*c*. A rear end surface of second thrust plane beating 327 projects slightly from the front end surface of inner block 320. A front end surface of fixing pins 327*a* is behind the rear end surface of second thrust plane bearing 327. Thus, second thrust plane beating 327 also may be in frictional contact with annular flange 314*c* and may receive a rearward thrust force through annular flange 314*c***.

Further, first thrust plane bearing 326 includes a pair of annular elements which are disposed upon each other. A first annular element may be made of steel, and a second annular element may be is made of phosphor bronze which is softer than steel. This pair of annular elements are fixedly bonded to each other by, for example, sintering. The second annular element of phosphor bronze faces annular flange **314*c* of steel, so that first thrust plane bearing 326 may be in frictional contact with annular flange 314*c* in a soft to hard metal contact. As a result, abrasion resistance of the fictional contact surfaces between first thrust plane bearing 326 and annular flange 314*c* is increased. Further, construction of second thrust plane beating 327 is similar to that of first thrust plane beating 326** and, therefore, further explanation thereof is omitted.

Fluid passage 371 is axially formed through pin member **314*b* and cylindrical rotor 314*a*. One end of fluid passage 371 is open to an axial air gap 372 created between the rear end surface of bushing 344 and the from end surfaces of circular end plate 341 and orbiting scroll 340. The other end of fluid passage 371 is open to a radial air gap 381 created between an inner peripheral surface of second annular sleeve 311 d and an outer peripheral surface of the inner end portion of drive shaft 314. Radial air gap 381 is linked to a hollow space 382, which is defined by second annular sleeve 311*d* of front end plate 311 and front annular projection 321 of inner block 320, through either an axial air gap 383 created between annular flange 314*c* and first thrust plane bearing 326 or radial grooves 326*d* formed at the axial outer end surface of second annular element 326*c* of first thrust plane beating 326. Hollow space 382 is linked to a lower portion of second discharge chamber 380 through conduit 328, which is radially formed through inner block 320**.

Oldham coupling mechanism 350, which operates as the rotation preventing device for orbiting scroll 340, is disposed between circular end plate 341 of orbiting scroll 340 and rear annular projection 322 of inner block 320. As a result of the operation of Oldham coupling mechanism 350, the rotation of drive shaft 314 causes orbiting scroll 340 to orbit without rotating.

Further, radial plane bearing 325 incudes a pair of annular cylindrical elements which radially overlay each other. A first annular cylindrical element may be made of steel, and a second annular cylindrical element may be made of phosphor bronze which is softer than steel. This pair of annular cylindrical elements may be fixedly bonded to each other by, for example, sintering. An inner peripheral surface of the second annular cylindrical element of phosphor bronze faces an outer peripheral surface of cylindrical rotor **314*a* of steel, so that radial plane bearing 325 is in frictional contact with cylindrical rotor 314*a* in a soft to hard metal contact. As a result, the abrasion resistance of the frictional contact surfaces between radial plane bearing 325 and cylindrical rotor 314*a* is increased. However, construction of radial plane bearing 345 is similar to that of radial plane bearing 325**, so that further explanation thereof is eliminated.

In view of their reduced cost and increased durability, radial plane bearings 325 and 345 and first and second thrust plane bearings 326 and 327, as described above, are superior to conventional bearings, such as a ball bearing.

During operation, as orbiting scroll 340 orbits, the line contacts between spiral elements 332 and 342 move toward the center of these spiral elements along the spiral curved surface of spiral elements 332 and 342. This causes the fluid pockets 390 to move toward the center with a consequent reduction in volume and compression of the fluid (e.g. refrigerant) within fluid pockets 390. Refrigerant gas, which may be introduced from a component, such as an evaporator (not shown), of a refrigerant circuit (not shown), through fluid inlet port 310*a*, is taken into fluid pockets 390 formed between spiral elements 332 and 342 from the outer end portion of these spiral elements.

The refrigerant gas taken into fluid pockets 390 is then compressed and discharged through discharge port 335 into first chamber section 360 from central fluid pocket 390*a* of spiral elements 332 and 342. Thereafter, the refrigerant gas in first discharge chamber 360 flows to second discharge chamber 380 through fluid passages 395, which are axially formed through outer peripheral wall 333 of fixed scroll 330 and rear annular projection 322 of inner block 320. The refrigerant gas flowing into second discharge chamber 380 then may flow through outlet port 310*b* to another component, such as a condenser (not shown) of the refrigerant circuit (not shown).

In addition, a lubricating oil 460, which accumulates at a bottom portion of the interior of first discharge chamber 360, flows into the bottom portion of the interior of second discharge chamber 380 through fluid passages 395, which are axially formed through outer peripheral wall 333 of fixed scroll 330 and rear annular projection 322 of inner block 320. Lubricating oil 460 is conducted into a hollow space 373 of suction chamber 370, which is created between inner block 320 and circular end plate 341 of orbiting scroll 340, by virtue of the pressure differential between second discharge chamber 380 and suction chamber 370 via conduit 328, hollow space 382, axial air gap 383 of first thrust plane bearing 326, fluid passage 371, axial air gap 372, and the radial air gaps created between boss 343 and radial plane beating 345 and between bushing 344 and radial plane beating 345. The lubricating oil conducted into hollow space 373 flows past Oldham coupling mechanism 350 to lubricate mechanism 350 and into suction chamber 370 at a position which is outside spiral elements 332 and 342.

Further, a quantity of the lubricating oil 460 which is conducted to radial air gap 381, flows toward shaft seal cavity 311*c*, and lubricates the internal fictional surfaces of mechanical seal element of shaft seal mechanism 414 and the frictional surface between the mechanical seal element and drive shaft 314. Moreover, shaft seal mechanism 414 comprises an elastic member and a sealing element which is sealing in contact with the peripheral surface of drive shaft 314. The elastic member constantly urges the sealing element into contact with the peripheral surface of drive shaft 314.

In this arrangement, the pressure in radial air gap 381 is sufficiently high so as to be substantially equal to that in hollow space 382 and second discharge chamber 380. Thereby, shaft seal mechanism 414 is usually subjected to high pressure during operation of compressor 300. Therefore, the sealing element is subjected to excess force created by the high pressure of discharge gas to the restoring force of the elastic member. As a result, shaft sealing mechanism 414 suffers from severe wear and frequent breakdown.

SUMMARY OF THE INVENTION

Accordingly, it is an object of the present invention to provide a fluid displacement apparatus in which the sealing mechanism of the drive shaft achieves superior durability while maintaining the lubrication of a beating under various operating conditions of the apparatus.

In an embodiment, the present invention is a fluid displacement apparatus which includes a housing having a fluid inlet port and a fluid outlet port. A fluid displacement mechanism having a first end and a second end is disposed within the housing for displacing a fluid suctioned from the inlet port to the outlet port. A driving mechanism is disposed in the housing and operatively connected to the fluid displacement mechanism. An inner block is fixedly disposed within the housing and supports a portion of the driving mechanism. A suction chamber is formed between the first end of the fluid displacement mechanism and the housing and communicates with the fluid inlet port. A discharge chamber is formed between the second end of the fluid displacement mechanism and the housing and communicates with the fluid outlet port. A first hollow space is created between a peripheral surface of the driving mechanism and the inner block and communicates with the suction chamber. A second hollow space is created between the inner block and the housing and communicates with the discharge chamber. A pressure differential regulating device is disposed between the first hollow space and the second hollow space for regulating a pressure differential between the first hollow space and the second hollow space.

Other objects, features, and advantages will be apparent to persons of ordinary skill in the an in view of the following detailed description of the invention and the accompanying drawings.

BRIEF DESCRIPTION OF THE DRAWINGS

For a more complete understanding of the present invention and the objects, features, and advantages thereof, reference is now made to the following description taken in conjunction with the accompanying drawings, wherein like reference numerals represent like parts.

DETAILED DESCRIPTION OF PREFERRED EMBODIMENTS

Figure 1:
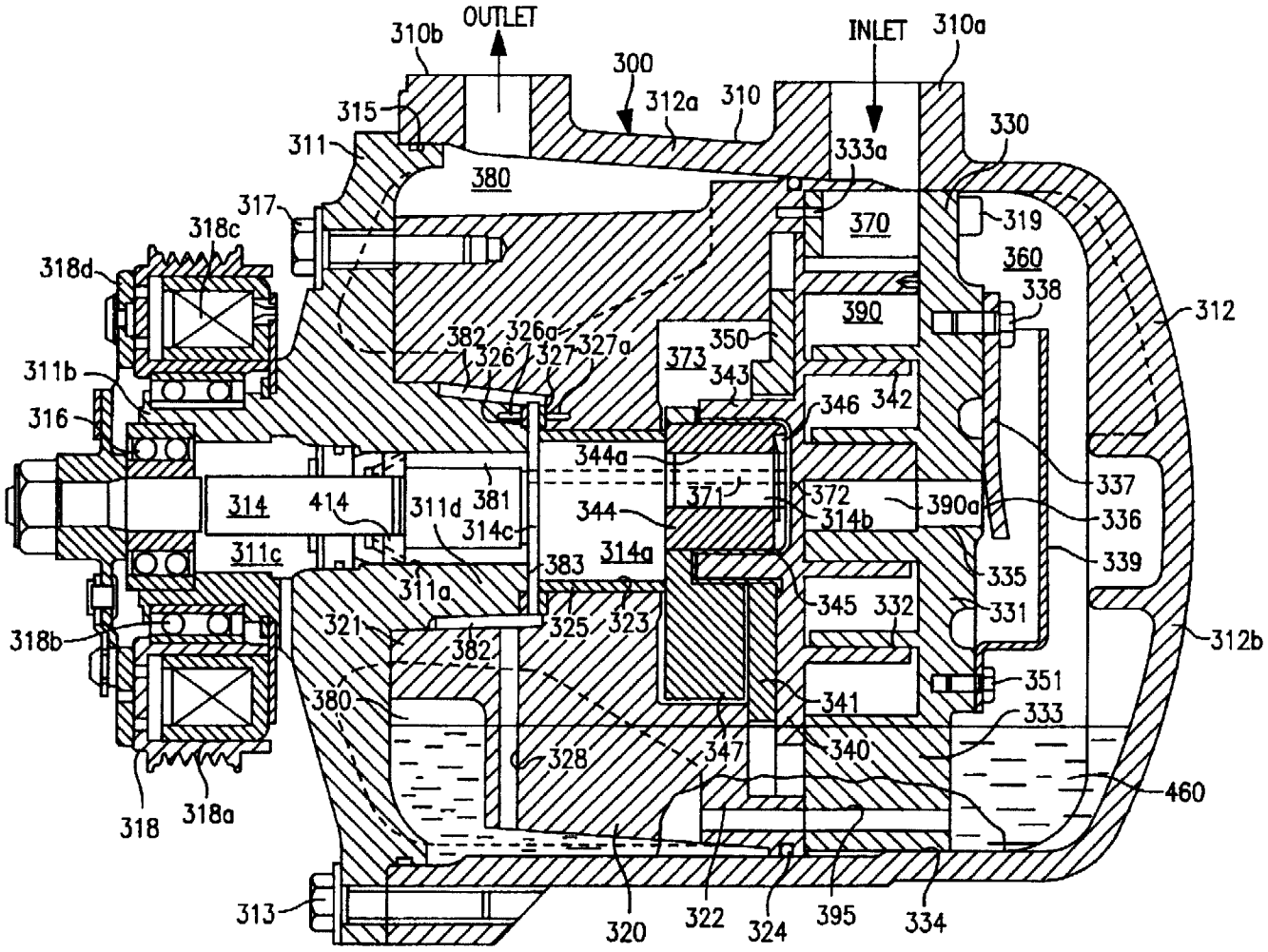
FIG. 1 PRIOR ART
FIG. 1 is a longitudinal cross-sectional view of a scroll-type refrigerant compressor in accordance with a prior art embodiment.
Figure 2:
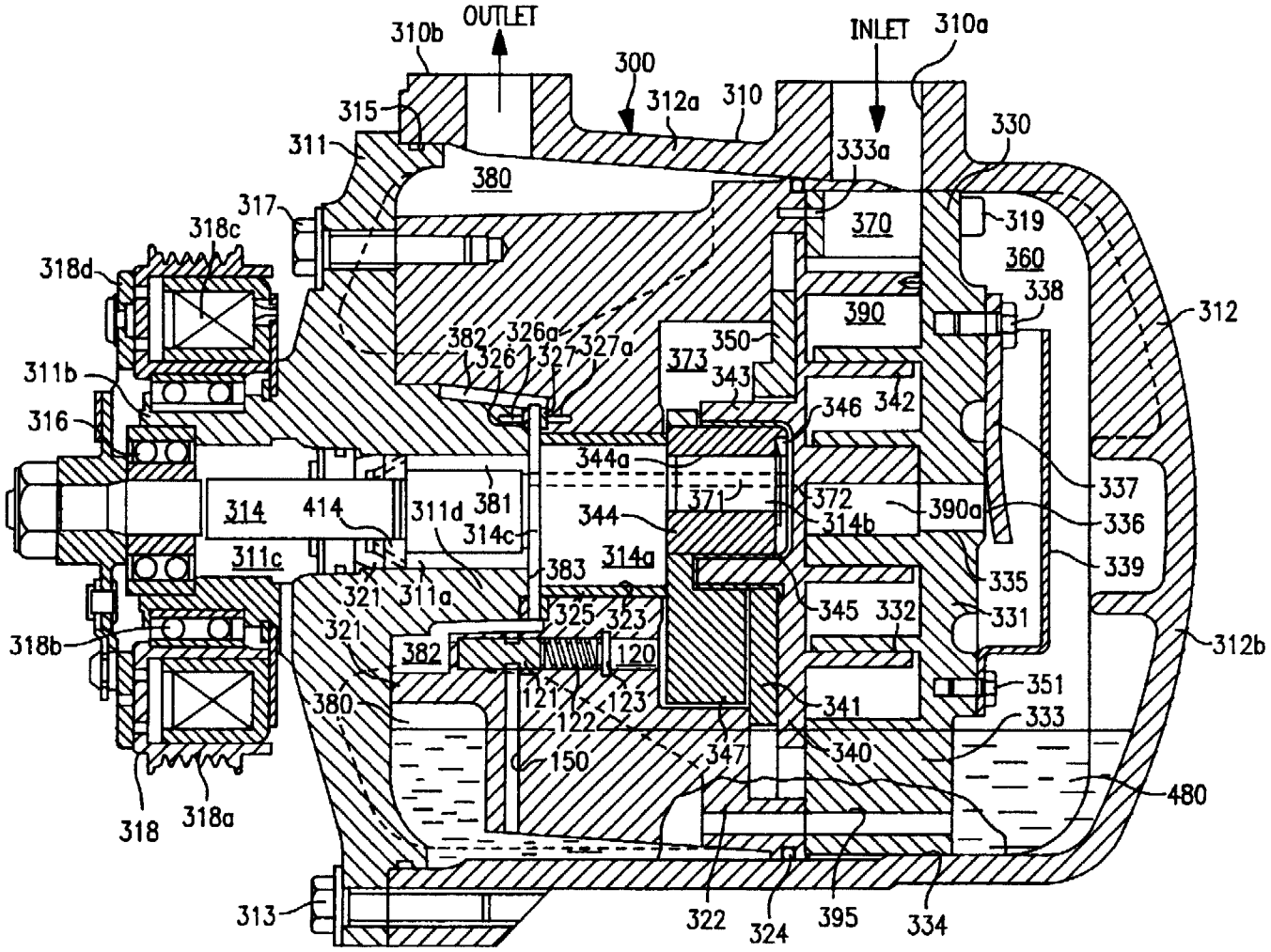
FIG. 2 is a longitudinal cross-sectional view of a scroll-type refrigerant compressor in accordance with an embodiment of the present invention.

FIG. 2 shows a portion of a fluid displacement apparatus, such as a scroll-type refrigerant compressor, in accordance with a first embodiment of the present invention. The same numerals are used in FIG. 2 to denote the corresponding elements shown in FIG. 1, and, therefore, further detailed explanation thereof is omitted. Further, in FIG. 2, for purposes of explanation only, the left side of the figure is referred to as the forward end or front of the compressor, and the right side of the figure is referred to as the rearward end or rear of the compressor.

With reference to FIG. 2, cylinder block 320 includes conduit 150, which extends longitudinally from a lower end surface to an upper end surface of inner block 320 and is formed in inner block 320 to link second discharge chamber and hollow space 382. Conduit 150 controls the flow of lubricating oil from second discharge chamber 380 to hollow space 382. Conduit 150 preferably has a circular shape in axial cross section, but may have other geometric shapes, such as a rectangular or triangular shape, in axial cross-section. Further, cylinder block 320 includes cylinder 120 formed to be substantially perpendicular to conduit 150 and communicating hollow space 382 with hollow space 373.

Figure 3:
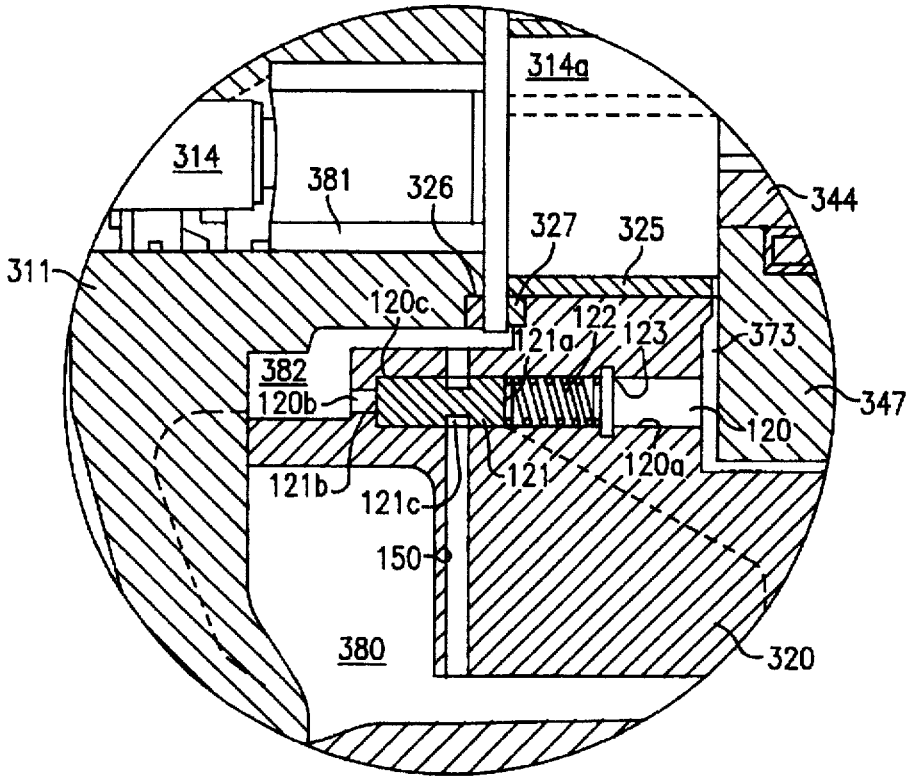
FIG. 3 is an enlarged partial longitudinal cross-sectional view of a pressure differential relating device of scroll-type refrigerant compressor, as shown in FIG. 2.
Figure 6:
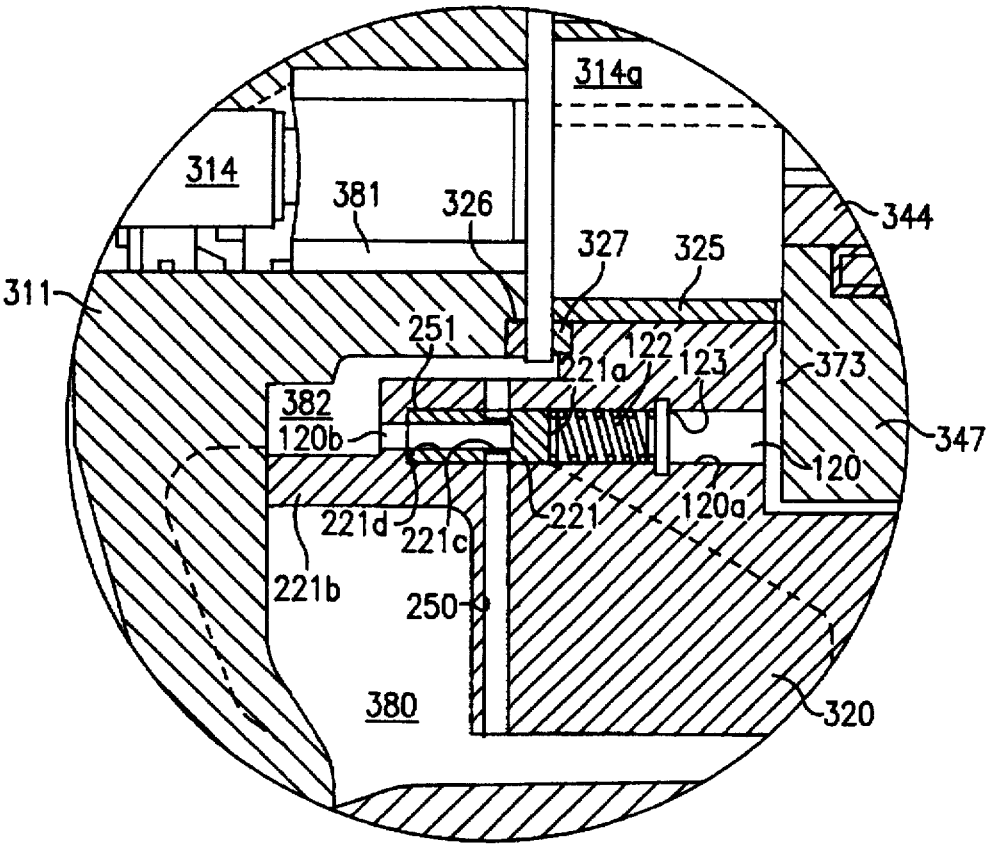
FIG. 6 is an enlarged partial longitudinal cross-sectional view of a pressure differential regulating device of scroll-type refrigerant compressor in accordance with a second embodiment of the present invention.
Figure 9:
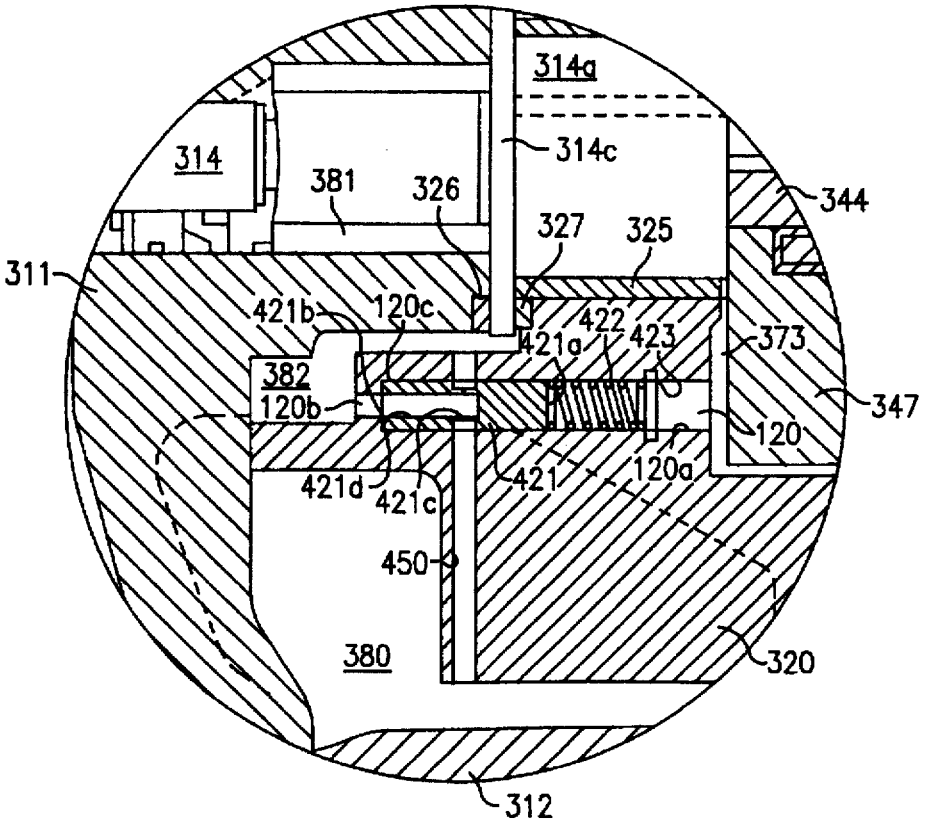
FIG. 9 is an enlarged partial longitudinal cross-sectional view of a pressure differential regulating device of scroll-type refrigerant compressor in accordance with a third embodiment of the present invention.

Referring to FIGS. 3, 6, and 9, cylinder 120 is divided into first cylinder portion 120*a* formed in the side of hollow space 373, second cylinder portion 120*b* formed in the side of hollow space 382, and shoulder portion 120*c* joining first cylinder portion 120*a* to second cylinder portion 120*b*. In addition, cylinder 120 is provide with piston 121 which axially reciprocates within cylinder 120.

Referring to FIG. 3, piston 121 includes first end 121*a* formed at a first end thereof and second end 121*b* formed at a second end thereof. A coil spring 122 is disposed between first end portion 121*a* and a snap ring 123 secured to inner wall of cylinder 120 so as to urge piston 121 toward second cylinder portion 120*b*. Piston 121 incudes annular groove 121*c* formed on the peripheral surface of piston 121. Annular groove 121*c* regulates the flow of lubricating oil passing through conduit 150 by sliding piston valve 121. Piston 121 is biased by spring coil 122, so that second end 121*b* contacts shoulder portion 120*c*.

Figure 4:
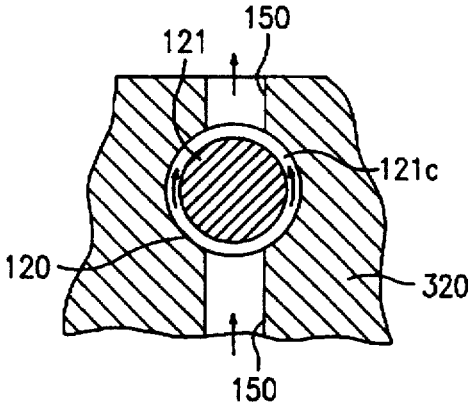
FIG. 4 is an enlarged partial cross-sectional view of a piston member opening the oil passage shown in FIG. 3.

The operation of pressure differential regulating device is now described in greater detail. When piston 121 is at the position shown in FIG. 3, the complete width of annular groove 121*c* communicates with conduit 150. Lubricating oil 460, which has accumulated at a bottom portion of the interior of discharge chamber 380, is conducted into hollow space 382 through conduit 150 via annular groove 121*c*, as shown in FIG. 4, because the pressure in second discharge chamber 380 is higher than that in hollow space 382.

Figure 5:
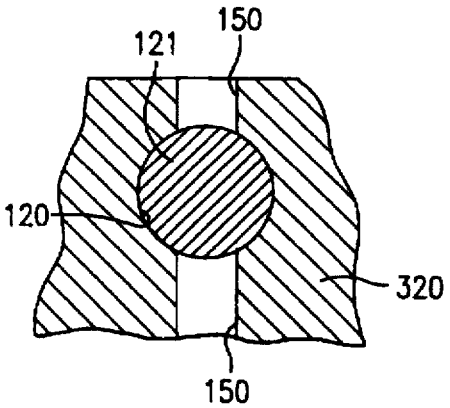
FIG. 5 is an enlarged partial cross-sectional view of a piston member closing the oil passage shown in FIG. 3.

The pressure in hollow space 382 gradually increases as hollow space 382 fills with lubricating oil. Piston 121 then slides rearward against the restoring force of spring coil 122 due to the pressure difference between hollow space 382 and hollow space 373 because the pressure of hollow space 382 is higher than that of hollow space 373. Consequently, with reference to FIG. 5, annular groove 121*c* also moves rearward compressing spring coil 122 so as to throttle the passage of conduit 150. Therefore, the flow of the lubricating oil passing through conduit 150 gradually decreases.

A quantity of the lubricating oil, which is conducted into hollow space 382, flows through second thrust plane bearing 327 and then flows into hollow space 373 of suction chamber 370 through a radial air gap created between an outer peripheral surface of radial plane bearing 325 and an inner peripheral surface of opening 323 of inner block 320 and a radial air gap created between an inner peripheral surface of radial plane beating 325 and an outer peripheral surface of cylindrical rotor 314*a*. In addition, a quantity of the lubricating oil which is conducted at hollow space 373 flows into axial air gap 372 through a radial air gap created between outer peripheral surface of radial plane beating 345 and an inner peripheral surface of boss 343 and a radial air gap created between an inner peripheral surface of radial plane bearing 345 and an outer peripheral surface of bushing 344. Further, a quantity of the lubricating oil, which is conducted to radial air gap 381, flows toward shaft seal cavity 311 and lubricates the internal frictional surfaces of the mechanical seal element of shaft seal mechanism 414 and the frictional surface between the mechanical seal element and drive shaft 314. Therefore, the pressure in hollow space 382 gradually decreases as lubricating oil 460 introduced from second discharge chamber 380 flows into the spaces described above. Piston 121 slides toward second cylinder portion 120*b* due to the restoring force of spring coil 122 applied against the pressure difference between hollow space 382 and hollow space 373. Consequently, annular groove 121*c* also returns to second cylinder portion 120*b* so as to open the passage of conduit 150, and the flow of the lubricating oil passing through conduit 150 gradually increases.

Accordingly, as the pressure differential regulating device repeats the cycle of actions described above, constant pressure at a level lower than that of second discharge chamber 380 may be maintained in hollow space 382. The pressure differential between second discharge chamber 380 and hollow space 382 may be constantly maintained without regard to varying conditions of compressor operation, such as the rotational speed of the compressor or heat load circumference of the cooling system. As a result, shaft seal mechanism 414 is not subjected to high pressure during operation of the compressor. This improvement increases the durability of shaft seal mechanism 414. Further, the frictional surfaces of the internal components of the compressor, such as the frictional surface between bushing 344 and radial plane bearing 345, are effectively and constantly lubricated.

Figure 7:
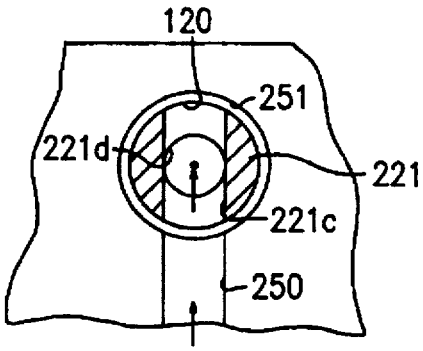
FIG. 7 is an enlarged partial cross-sectional view of a piston member opening the oil passage shown in FIG. 6.
Figure 8:
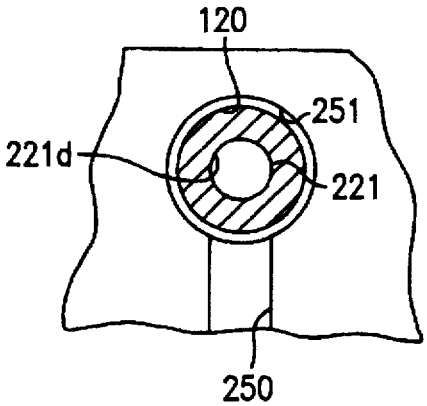
FIG. 8 is an enlarged partial cross-sectional view of a piston member closing the oil passage shown in FIG. 6.

Referring to FIGS. 6, 7, and 8, a second embodiment of the present invention is shown which possesses structures and features similar to those of the first embodiment, except for at least the structures described below. With reference to FIG. 6, cylinder block 320 includes aperture 250 communicating with first cylinder portion 120*a*. Aperture 120 preferably has a circular shape in axial cross-section, but may have other geometric shapes, such as a rectangular or triangular shape, in axial cross-section. Further, annular groove 251 is radially formed on an inner wall of first cylinder portion 120*a* so as to contain a first end opening of aperture 250. An axial width of annular groove 251 is greater than or equal to the diameter of aperture 250. Further, hole 221*c* is formed in the axial center of piston 221 so as to penetrate from one peripheral surface to the other peripheral surface of piston 221. The diameter of hole 221*c* is substantial greater than or equal to that of aperture 250. Further, piston 221 includes opening 221*d* extending from second end portion 221*b* along the longitudinal axis of piston 221 to hole 221*c* so as to communicate with hole 221*c*.

The operation of this embodiment of pressure differential regulating device is now described greater detail. When piston 221 is at the position shown in FIG. 6, the complete width of hole 221*c* communicates with aperture 250. Lubricating oil 460, which has accumulated at a bottom portion of the interior of discharge chamber 380, is conducted into hollow space 382 through aperture 250 via hole 221*c*, as shown in FIG. 7, because the pressure of second discharge chamber 380 is higher than that of hollow space 382.

The pressure in hollow space 382 gradually increases as hollow space 382 is filled with lubricating oil. Piston 221 then slides rearward against the restoring force of spring coil 122 due to the pressure difference between hollow space 382 and hollow space 373 because the pressure of hollow space 382 is higher than that of hollow space 373. Consequently, with reference to FIG. 8, hole 221*c* also moves rearward compressing spring coil 122 so as to throttle the passage of aperture 250. Therefore, the flow of the lubricating oil, which passes through aperture 250, gradually decreases.

The pressure in hollow space 382 will then gradually decrease as lubricating oil 460 in hollow space 382 flows into spaces described above. Piston 221 slides toward second cylinder portion 120*b* due to the restoring force of spring coil 122 applied against the pressure difference between hollow space 382 and hollow space 373. Hole 221*c* also returns to second cylinder portion 120*b* so as to open the passage of aperture 250, and the flow of the lubricating oil passing through aperture 250 gradually increases.

In such structure, substantially the same advantages as those achieved in the first embodiment are obtained.

Figure 10:
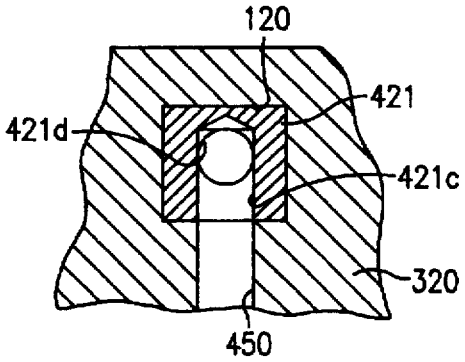
FIG. 10 is an enlarged partial cross-sectional view of a piston member opening the oil passage shown in FIG. 9.

Referring the FIGS. 9, 10, and 11, a third embodiment of the present invention is shown which possesses structures and features similar to those of the first embodiment, except for at least the structures described below. With reference to FIG. 9, cylinder block 320 includes aperture 450 radially formed therein and communicating with first cylinder portion 120*a*. Aperture 450 preferably has a circular shape in axial cross-section, but may have other geometric shapes, such as a rectangular or a triangular shape, in axial cross-section. Further, piston 421 is formed to be rectangular parallelepiped and to include first end 421*a* and second end 421*b*. Piston 421 includes first aperture 421*c* formed in the axial center thereof so as to extend from one peripheral surface of piston 421 and to communicate with second aperture 421*d*. The diameter of hole 421*c* is substantially greater than or equal to that of aperture 450. Second aperture 421*d* extends from second end portion 421*b* along a longitudinal axis of piston 421 to aperture 421*c* so as to communicate with hole 421*c*. Lubricating oil flows into hollow space 382 from conduit 450 through first aperture 421*c* and second aperture 421*d* as shown in FIG. 10.

Figure 11:
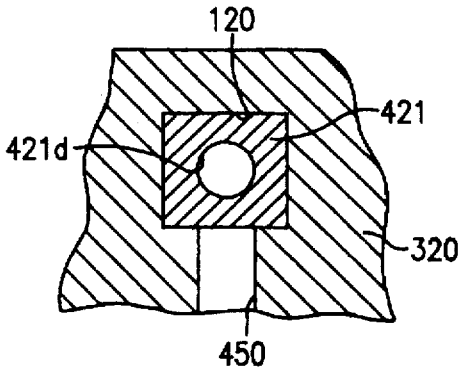
FIG. 11 is an enlarged partial cross-sectional view of a piston member closing the oil passage shown in FIG. 9.

Referring to FIG. 11, the operation of valve mechanism is similar to a second embodiment. Therefore, further detailed explanation is omitted. In such structures as are disclosed in FIGS. 9, 10, and 11, substantially the same advantages as those achieved with respect to the first embodiment may be obtained.

Figure 12:
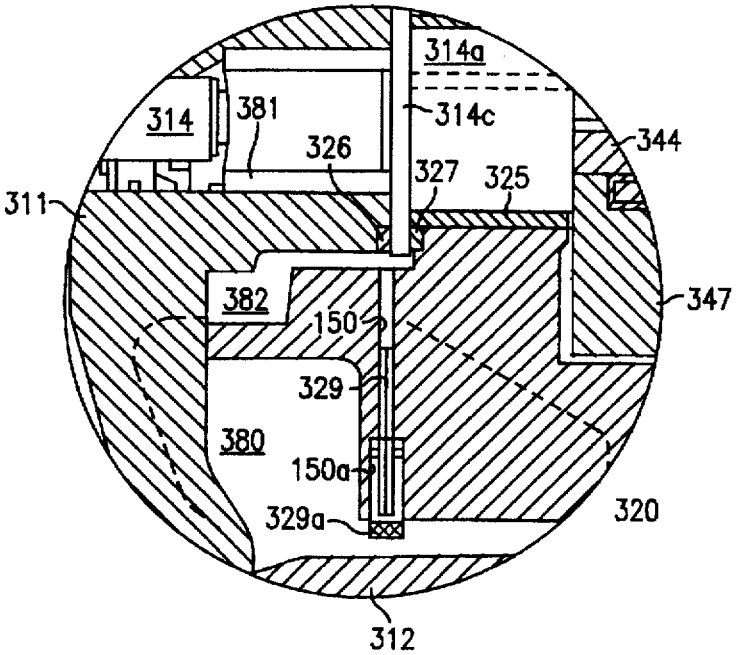
FIG. 12 is an enlarged partial longitudinal cross-sectional view of a pressure differential regulating device of scroll-type refrigerant compressor in accordance with a fourth embodiment of the present invention.

Referring to FIG. 12, a fourth embodiment of the present invention is shown which possesses structures and features similar to those of the first embodiment, except for at least the structures described below. Conduit 150, which extends longitudinally from a lower end surface to an upper end surface of inner block 320, is formed in inner block 320 to link second discharge chamber 380 and hollow space 382. Conduit 150 controls the flow of lubricating oil from second discharge chamber 380 to hollow space 382. Large diameter conduit portion 150*l* of conduit 150 has filter screen 329*a* disposed therein. Capillary tube 329, which performs a throttling function to reduce the pressure differential of lubricating oil between second discharge chamber 380 to hollow space 382, is fixed within conduit 150 and is coupled to filter screen 329*a*.

Further, cylinder block 320 may include communication path 450 designed to be formed as a capillary tube. Path 450 then performs a throttling function to reduce the pressure differential of lubricating oil between second discharge chamber 380 to hollow space 382, as shown in FIG. 13.

Figure 13:
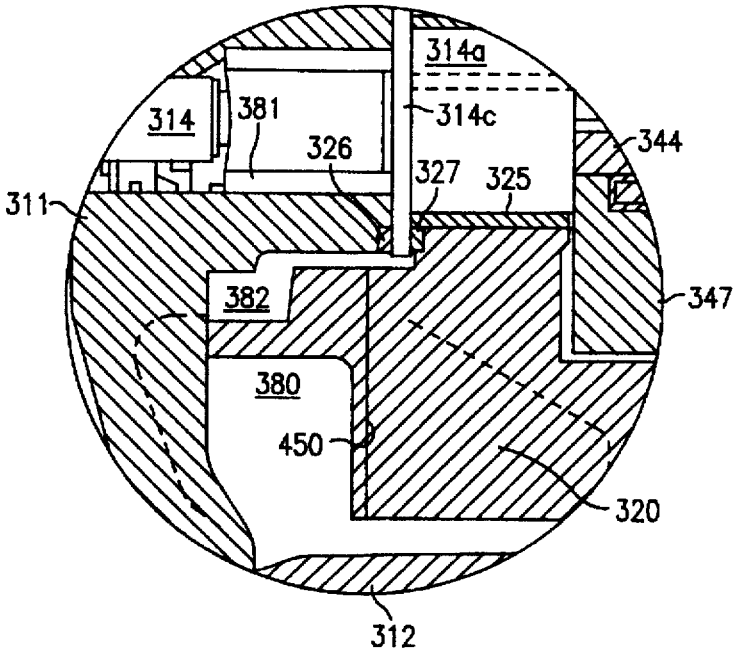
FIG. 13 is an enlarged partial longitudinal cross-sectional view of a pressure differential regulating device of scroll-type refrigerant compressor in accordance with a fifth embodiment of the present invention.

In such structures as are disclosed in FIGS. 12 and 13, substantially the same advantages as those achieved in the first embodiment also may be obtained.

This invention has been described in detail in connection with preferred embodiments, but these embodiments are merely exemplary, and the invention is not to be construed as limited thereto. It will be apparent to those skilled in the an that other variations or modifications may be made within the scope defined by the appended claims. Thus, while the preferred embodiments illustrate the invention as in a scroll-type fluid displacement apparatus, the invention may be used in other types of fluid displacement apparatus, such as a slant-plate type or wobble-type fluid displacement apparatus.

We claim:

1. In a fluid displacement apparatus comprising:

a housing having a fluid inlet port and a fluid outlet port;

a fluid displacement mechanism having a first end and a second end disposed within said housing for displacing a fluid suctioned from said inlet port to said outlet port;

a driving mechanism disposed in said housing and operatively connected to said fluid displacement mechanism;

an inner block fixedly disposed within said housing and supporting a portion of said driving mechanism;

a suction chamber formed between an outer circumference of said fluid displacement mechanism and said housing, said suction chamber communicating with said fluid inlet port;

a discharge chamber formed between said second end of said displacement mechanism and said housing, said discharge chamber communicated with said fluid outlet port;

a first hollow space created between a peripheral surface of said driving mechanism and said inner block, and communicating with said suction chamber;

a second hollow space created between said inner block and said housing, and communicating with said discharge chamber; and a pressure differential regulating device disposed between said first hollow space and said second hollow space for regulating pressure differential between said first hollow space and second hollow space.

2. The fluid displacement apparatus of claim 1, wherein said pressure differential regulating device further comprises a communication passage which places said first hollow space in communication with said second hollow space, and a pressure differential responsive device for regulating opening and closing of said communication passage.

3. The fluid displacement apparatus of claim 2, wherein said pressure differential responsive device is a piston mechanism comprising a cylinder which places said suction chamber in communication with said second hollow space, a piston member reciprocating within said cylinder and an elastic member biasing said piston member.

4. The fluid displacement apparatus of claim 3, wherein said piston member includes a groove formed on a peripheral surface thereof which places said first hollow space in communication with said second hollow space via said communication passage.

5. The fluid displacement apparatus of claim 3, wherein said piston member includes a hole formed therein which places said first hollow space in communication with said second hollow space via said communication passage.

6. The fluid displacement apparatus of claim 5, wherein said hole comprises a first hole portion perpendicular to an axis of said piston member and a second hole portion parallel to an axis of said piston member.

7. The fluid displacement apparatus of claim 1, wherein said pressure differential regulating device is a reducing pressure device for reducing a pressure of said first hollow space to less than that of said second hollow space.

8. The fluid displacement apparatus of claim 7, wherein said reducing device is a capillary tube.

9. The fluid displacement apparatus of claim 1, wherein said fluid displacement mechanism further comprises a fixed scroll disposed within said housing and having a first end plate from which a first spiral element extends, an orbiting scroll disposed within said housing and having a second end plate from which a second spiral element extends, said first spiral element and said second spiral element interfitting at an angular and radial offset to form a plurality of linear contacts defining at least one pair of sealed-off fluid pockets, and said driving mechanism further comprises a drive shaft axially disposed in said housing and operatively connected to said orbiting scroll to effect orbital motion of said orbiting scroll.

* * * * *